US012280857B1

(12) United States Patent
Duffield et al.

(10) Patent No.: US 12,280,857 B1
(45) Date of Patent: Apr. 22, 2025

(54) SEAT SLIDE-LOCK SYSTEM

(71) Applicant: Protomet Corporation, Oak Ridge, TN (US)

(72) Inventors: Matthew Duffield, Harriman, TN (US); Brian Pitcher, Knoxville, TN (US); Tyler Gooden, Harriman, TN (US)

(73) Assignee: Protomet Corporation, Oak Ridge, TN (US)

( * ) Notice: Subject to any disclaimer, the term of this patent is extended or adjusted under 35 U.S.C. 154(b) by 0 days.

(21) Appl. No.: 18/986,977

(22) Filed: Dec. 19, 2024

(51) Int. Cl.
*B63B 29/04* (2006.01)

(52) U.S. Cl.
CPC ..... *B63B 29/04* (2013.01); *B63B 2029/043* (2013.01)

(58) Field of Classification Search
CPC ..... B63B 29/04; B63B 2029/043
See application file for complete search history.

(56) References Cited

U.S. PATENT DOCUMENTS

2007/0120407 A1* 5/2007 Kojima ..... B60N 2/0825 297/344.11
2008/0309136 A1* 12/2008 Kojima ..... B60N 2/12 297/340
2013/0193732 A1* 8/2013 Brand ..... B60N 2/0745 297/344.21
2023/0339578 A1* 10/2023 Jennings ..... B60N 2/0705

* cited by examiner

*Primary Examiner* — David R Dunn
(74) *Attorney, Agent, or Firm* — Robinson IP Law, PLLC

(57) ABSTRACT

The present disclosure provides a seat slide-lock system including a seat slide rail having a longitudinal axis and defining at least one detent, and a seat movable along the longitudinal axis of the seat slide rail. The seat includes a seat slide-lock device including a slide handle accessible to a user and movable between an engaged position and a disengaged position, a slide pin coupled to the slide handle and movable therewith, and a release switch accessible to the user and movable between a locked position and an unlocked position. The slide pin is engageable with the detent in the engaged position, preventing seat movement, and disengaged in the disengaged position, allowing seat movement. The release switch prevents the slide handle and slide pin from moving from the disengaged position toward the engaged position when locked and allows such movement when unlocked.

22 Claims, 6 Drawing Sheets

SEAT SLIDE-LOCK SYSTEM

BACKGROUND

Watercraft seating plays a crucial role in ensuring passenger comfort, safety, and enjoyment during marine activities. As recreational boating and water sports continue to gain popularity, there is an increasing demand for versatile and adjustable seating arrangements that can accommodate various passenger needs and preferences.

Traditionally, boat seats have been fixed in place or offered limited adjustment capabilities. However, modern watercraft designs often incorporate sliding seat systems that allow for greater flexibility in positioning and space utilization. These sliding mechanisms enable users to optimize seating configurations based on factors such as the number of passengers, weight distribution, and intended activities.

While sliding seat systems offer numerous advantages, they also present unique challenges in the marine environment. The constant motion of a vessel on water and the potential for sudden impacts or changes in direction all contribute to the complexity of designing effective and durable seat adjustment mechanisms.

One critical aspect of sliding seat systems is the ability to securely lock the seat in place when desired. This feature is essential for maintaining passenger safety, particularly in rough water conditions or during high-speed maneuvers. However, the locking mechanism must also be easily operable, allowing users to quickly adjust seat positions as needed.

As watercraft manufacturers continue to innovate and refine their designs, the integration of more sophisticated and user-friendly seating solutions remains an area of ongoing development and improvement.

SUMMARY

Various implementations include a seat slide-lock system. The system includes a seat slide rail having a longitudinal axis. The seat slide rail defines at least one detent. The system includes a seat movable along the longitudinal axis of the seat slide rail. The seat includes a seat slide-lock device. The system includes a slide handle accessible to a user. The slide handle is movable between an engaged position and a disengaged position. The system includes a slide pin coupled to the slide handle such that the slide pin moves with the slide handle when the slide handle moves between the engaged position and the disengaged position. The slide pin is engageable with the detent of the seat slide rail in the engaged position and is disengaged with the detent of the seat slide rail in the disengaged position. The seat is prevented from moving relative to the longitudinal axis of the seat slide rail in the engaged position and is allowed to move relative to the longitudinal axis of the seat slide rail in the disengaged position. The system includes a release switch accessible to the user. The release switch is movable between a locked position and an unlocked position. The release switch is configured to prevent the slide handle and slide pin from moving from the disengaged position toward the engaged position when in the locked position. The release switch is configured to allow the slide handle and slide pin to move from the disengaged position toward the engaged position when in the unlocked position.

In some implementations, the slide pin and slide handle are biased toward the engaged position by a pin spring and are urgable toward the disengaged position.

In some implementations, the release switch is biased toward the locked position by a release spring and is urgable toward the unlocked position.

In some implementations, the release switch includes a pressable button. In some implementations, the release switch is in the locked position when the pressable button is in an extended position and is in the unlocked position when the pressable button is in a depressed position.

In some implementations, the release switch is prevented from moving from the unlocked position toward the locked position when the slide handle and slide pin are in the engaged position.

In some implementations, the release switch includes a release protrusion. In some implementations, the slide handle defines a release opening. In some implementations, the release protrusion engages the release opening and obstructs movement of the slide handle from the disengaged position to the engaged position when the release button is in the locked position. In some implementations, the release protrusion does not engage the release opening or obstruct the movement of the slide handle from the disengaged position to the engaged position when the release button is in the unlocked position. In some implementations, the slide handle obstructs the movement of the release protrusion from the unlocked position toward the locked position when the slide handle is in the engaged position.

In some implementations, the slide handle is further from the seat slide rail in the disengaged position than it is in the engaged position.

In some implementations, the system further includes a visual indicator to indicate to the user that the slide pin and slide handle are in the disengaged position. In some implementations, the visual indicator is statically couplable to the slide pin and slide handle such that the visual indicator moves with the slide pin and slide handle when the slide pin and slide handle move between the engaged position and the disengaged position. In some implementations, the visual indicator extends outwardly from a portion of the seat when the slide pin and slide handle are in the disengaged position. In some implementations, the visual indicator is disposed within the portion of the seat when the slide pin and slide handle are in the engaged position.

In some implementations, the seat slide rail defines two or more detents. In some implementations, the slide pin is engageable with each of the two or more detents.

In some implementations, the seat slide rail is a first seat slide rail. In some implementations, the system further includes a second seat slide rail. In some implementations, the seat slide-lock device is a first seat slide-lock device disposed along a first side of the seat. In some implementations, the seat further includes a second seat slide-lock device disposed along a second side of the seat.

In some implementations, the seat further includes one or more fixed pins. In some implementations, the seat slide rail defines a slide channel extending parallel to the longitudinal axis of the seat slide rail. In some implementations, the one or more fixed pins are slidably disposed within the slide channel.

Various other implementations include a seat slide-lock device. The device includes a slide handle accessible to a user. The slide handle is movable between an engaged position and a disengaged position. The device includes a slide pin coupled to the slide handle such that the slide pin moves with the slide handle when the slide handle moves between the engaged position and the disengaged position. The slide pin is engageable with a detent of a seat slide rail in the engaged position and is disengaged with the detent of the seat slide rail in the disengaged position. The seat is prevented from moving relative to a longitudinal axis of the seat slide rail in the engaged position and is allowed to move relative to the longitudinal axis of the seat slide rail in the disengaged position. The device includes a release switch accessible to the user. The release switch is movable between a locked position and an unlocked position. The release switch is configured to prevent the slide handle and slide pin from moving from the disengaged position toward the engaged position when in the locked position. The release switch is configured to allow the slide handle and slide pin to move from the disengaged position toward the engaged position when in the unlocked position.

In some implementations, the slide pin and slide handle are biased toward the engaged position by a pin spring and are urgable toward the disengaged position.

In some implementations, the release switch is biased toward the locked position by a release spring and is urgable toward the unlocked position.

In some implementations, the release switch includes a pressable button. In some implementations, the release switch is in the locked position when the pressable button is in an extended position and is in the unlocked position when the pressable button is in a depressed position.

In some implementations, the release switch is prevented from moving from the unlocked position toward the locked position when the slide handle and slide pin are in the engaged position.

In some implementations, the release switch includes a release protrusion. In some implementations, the slide handle defines a release opening. In some implementations, the release protrusion engages the release opening and obstructs the movement of the slide handle from the disengaged position to the engaged position when the release button is in the locked position. In some implementations, the release protrusion does not engage the release opening or obstruct the movement of the slide handle from the disengaged position to the engaged position when the release button is in the unlocked position. In some implementations, the slide handle obstructs the movement of the release protrusion from the unlocked position toward the locked position when the slide handle is in the engaged position.

In some implementations, the slide handle is configured to be further from the seat slide rail in the disengaged position than it is in the engaged position.

In some implementations, the device further includes a visual indicator to indicate to the user that the slide pin and slide handle are in the disengaged position. In some implementations, the visual indicator is statically couplable to the slide pin and slide handle such that the visual indicator moves with the slide pin and slide handle when the slide pin and slide handle move between the engaged position and the disengaged position. In some implementations, the visual indicator is configured to extend outwardly from a portion of the seat when the slide pin and slide handle are in the disengaged position. In some implementations, the visual indicator is configured to be disposed within the portion of the seat when the slide pin and slide handle are in the engaged position.

BRIEF DESCRIPTION OF FIGURES

Example features and implementations of the present disclosure are disclosed in the accompanying drawings. However, the present disclosure is not limited to the precise arrangements and instrumentalities shown. Similar elements in different implementations are designated using the same reference numerals.

DETAILED DESCRIPTION

Figure 1:
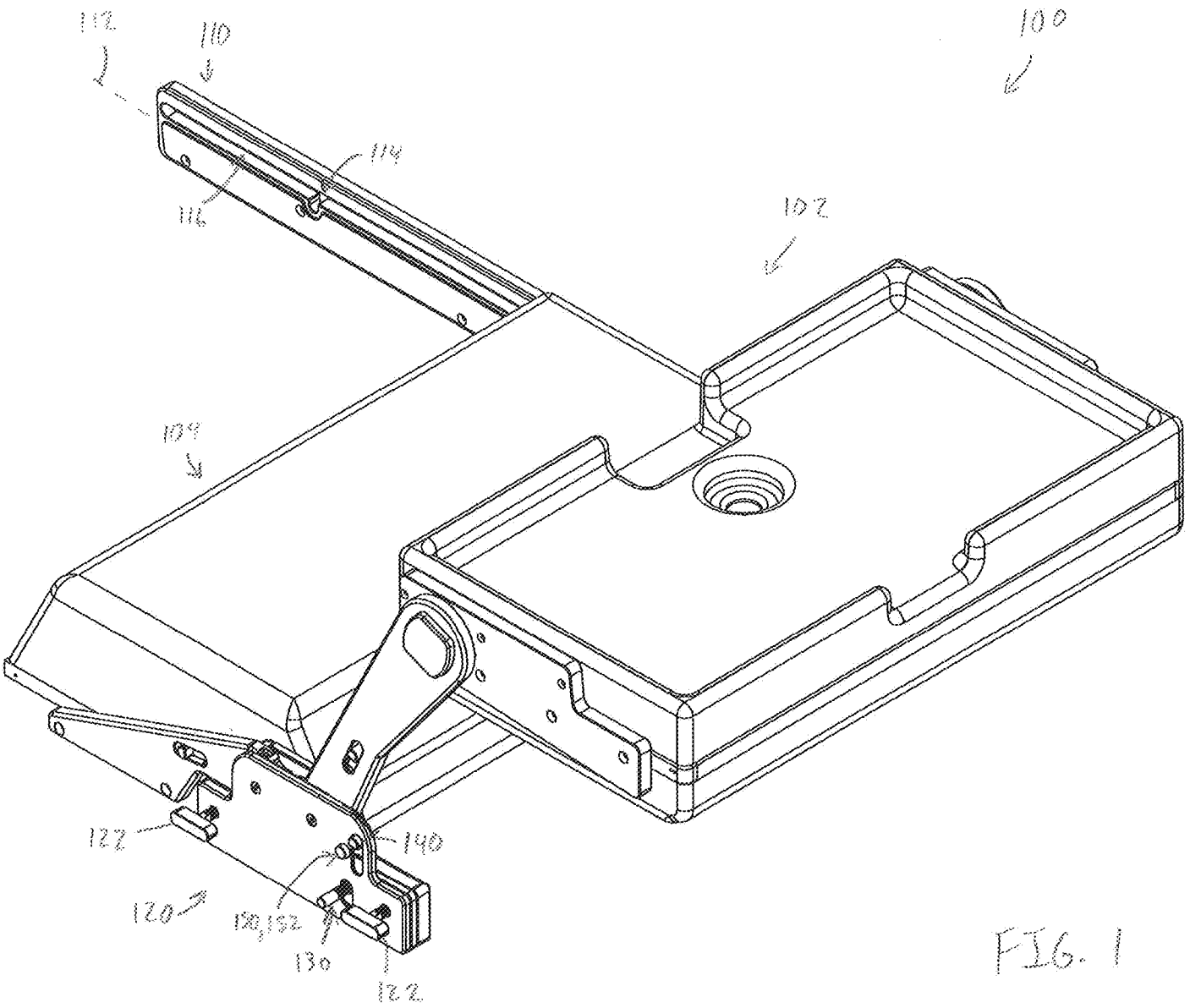
FIG. 1 shows a left side perspective view of a seat slide-lock system coupled to a seat, according to one implementation.

The present disclosure relates to a seat slide-lock system for adjustable seating arrangements. This system may be utilized in various applications where controlled seat movement and secure positioning are desired, such as in watercraft, automobiles, aircraft, or other transportation modes. The seat slide-lock system may allow a user to adjust the position of a seat along a predetermined path and securely lock the seat in place once the desired position is achieved.

In various implementations, the seat slide-lock system may include a seat slide-lock device mounted to the underside of a seat. The seat slide-lock device may include several key components working in conjunction to provide smooth movement and reliable locking functionality. These components may include a slide handle, a slide pin, and a release switch.

The slide handle may be accessible to a user and may allow for manual operation of the locking mechanism. The slide pin may be coupled to the slide handle and may engage with a seat slide rail to secure the seat in position. The release switch may provide an additional safety feature, preventing unintended movement of the seat when engaged.

This system may offer users the ability to easily adjust their seating position while ensuring that the seat remains securely locked in place during use. The combination of these components may result in a robust and user-friendly mechanism for seat adjustment and locking.

The seat slide-lock system described herein may offer several advantages over traditional sliding seat mechanisms. In some cases, the system may provide improved versatility and precision in seat positioning.

The multi-detent engagement may enhance safety and stability. By offering numerous secure locking points along the slide rail, the system may ensure that the seat remains firmly in place regardless of the chosen position. This may be particularly beneficial in dynamic environments, such as watercraft, vehicles, or aircraft, where sudden movements or vibrations could potentially compromise seat stability with less robust locking mechanisms.

In some cases, the multi-detent design may also contribute to improved ease of use. Users may be able to quickly and easily adjust their seating position by small increments, finding the most comfortable setting without being limited to a few widely spaced options. This fine-tuning capability may be especially valuable in situations where optimal positioning is crucial for comfort or task performance over extended periods.

The system's design may also offer enhanced durability compared to traditional sliding seat mechanisms. By positively engaging the detents or positive stops of the rail with the robust slide pins of the seat slide-lock mechanism, wear and tear on individual components may be reduced. This may potentially lead to a longer operational lifespan and reduced maintenance requirements for the seat slide-lock system.

The visual indicator may provide an important safety feature by offering clear and immediate feedback to the user regarding the locked status of the seat slide-lock system. When the system is securely locked in position, the visual indicator may be concealed or flush with the seat surface, indicating that the seat will not accidentally slide. Conversely, when the system is unlocked or in the disengaged position, the visual indicator may protrude or become visible, alerting the user that the seat is free to move. This visual cue may help prevent unintended seat movement, which could potentially lead to accidents or injuries, especially in dynamic environments such as moving vehicles, watercraft, or aircraft. By providing this easily observable status indication, the visual indicator may enhance overall system safety and user confidence in the seat's stability during use.

Overall, the seat slide-lock system with its multi-detent engagement capability may represent a significant improvement over prior art sliding seat mechanisms, offering enhanced versatility, safety, user comfort, durability, and space efficiency.

Figure 2:
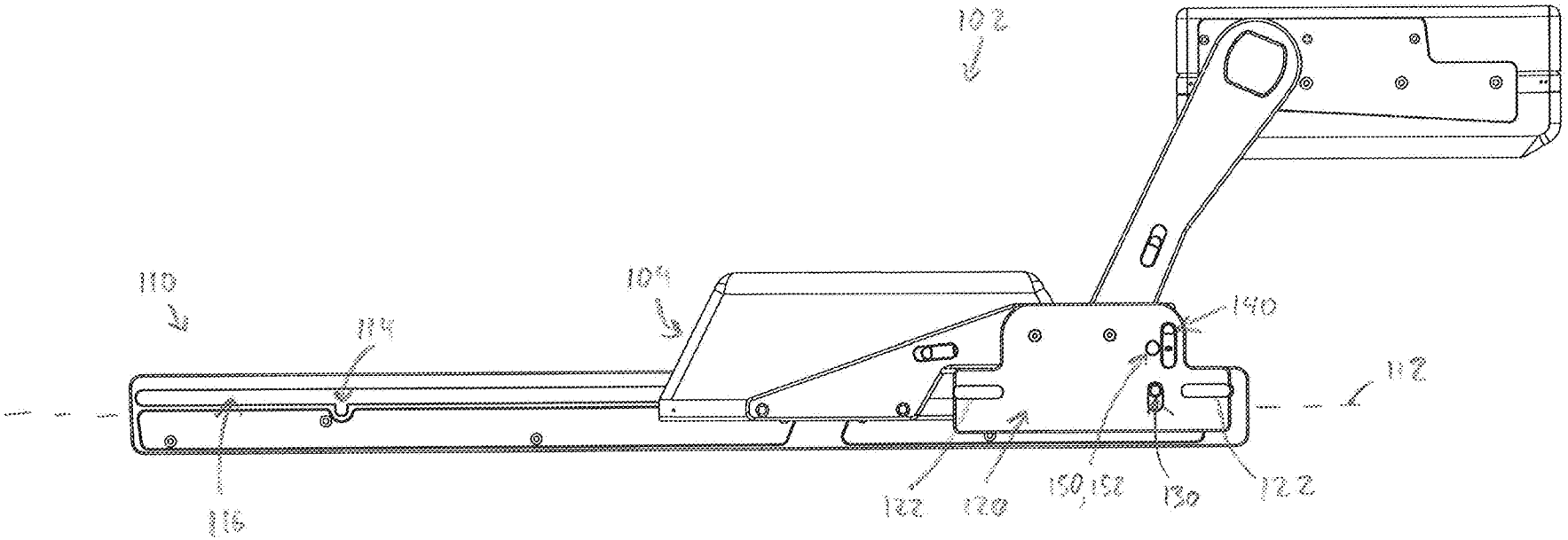
FIG. 2 shows a left side view of the seat slide-lock system coupled to the seat of FIG. 1.

In some cases, the seat slide-lock system 100 may include one or more seat slide rails. The seat slide rail 110 may have a longitudinal axis 112 extending along the length of the rail. FIG. 1 illustrates an isometric view of a seat slide-lock system 100, showing an elongated slide rail 110 attached to one side of a seat base structure 104. FIG. 2 provides a side orthogonal view of the system 100, depicting the seat slide rail 110 extending horizontally along the bottom of the image.

The seat slide rail 110 may define at least one detent or other positive stop 114 along its length. In some cases, the seat slide rail 110 may include two or more detents 114. These detents 114 may be spaced at regular or irregular intervals along the longitudinal axis 112 of the rail 110. The detents 114 may serve as engagement points for the slide pin 130 of the seat slide-lock device 120, allowing the seat 102 to be securely locked in various positions along the rail 110.

As used herein, the term "detent 114" may refer to any positive stop feature that is engageable by a slide pin 130 or other mechanism of the seat slide-lock device 120. The detent 114 may take various forms to provide secure engagement points along the seat slide rail 110. In some implementations, the detent 114 may be a recess or notch formed in the seat slide rail 110. In other cases, the detent 114 may be a protrusion or raised feature on the rail surface. Alternative forms of detents may include holes, slots, or grooves machined into the rail. In some aspects, the detent 114 may be a magnetic element embedded in the rail that interacts with a corresponding magnetic or ferrous component in the slide pin 130. The detent 114 may also be implemented as a friction-based stop, such as a textured surface area or a compressible material insert. In certain implementations, the detent 114 may be an adjustable or removable component, allowing for customization of locking positions along the rail.

In some cases, the seat slide rail 110 may define a slide channel 116 extending parallel to the longitudinal axis of the rail 110. This channel 116 shown in FIG. 2 is a groove running along the length of the slide rail 110. The slide channel 116 may accommodate one or more fixed pins 122 attached to the seat slide-lock device. These fixed pins 122 may be slidably disposed within the slide channel 116, allowing for smooth movement of the seat along the rail 110 while providing stability and guidance.

The seat slide rail 110 may be configured to facilitate the sliding movement of the seat 102 while also providing a secure locking mechanism. The rail 110 may be constructed from durable materials capable of withstanding repeated use and the weight of the seat 102 and its occupant. The surface of the rail 110 may be treated or coated to reduce friction and ensure smooth sliding motion. In some implementations, the seat slide rail 110 may be constructed from corrosion-resistant materials such as stainless steel, marine-grade aluminum, or specialized polymers, which may help prevent degradation when exposed to moisture or saltwater environments, potentially enhancing the system's durability and longevity in watercraft applications.

In some implementations, the seat slide-lock system 100 includes a second seat slide rail 110. Although FIG. 1 does not show a second seat rail 110, the second seat rail 110 can be implemented on the opposite side of the seat base 104 in a symmetrical or similar way. The use of two parallel seat slide rails 110 can provide increased stability and support for the system 100. In some implementations, the system 100 includes one seat slide rail 110 as discussed herein, and a second rail that is different from the seat slide rails 110 discussed herein, such as a typical rail without a detent 114. In such implementations, the a bearing can be included to provide the ability for the seat 102 to slide along the second rail without the ability to secure the position of the seat 102 along that side.

The seat slide rail 110 may interact with various components of the seat slide-lock system 100. For example, the detents 114 in the rail 110 may engage with the slide pin 130 of the seat slide-lock device 120 to secure the seat 102 in position. The slide channel 116 may guide the fixed pins 122 attached to the seat slide-lock device 120, ensuring proper alignment and smooth movement along the rail 110.

Although the seat slide-lock device 120 shown in FIGS. 1-6 are shown as fixed slide blocks, in some implementations, the fixed pins 122 can be any feature that engages the slide channel 116 of the slide rail 110 to provide stability of the seat 102 and/or smooth sliding movement of the seat 102.

In some cases, the seat slide-lock system 100 may include a seat 102 movable along the longitudinal axis 112 of the seat slide rail 110. The seat 102 may be designed to accommodate various applications, such as watercraft, vehicular, or aircraft seating, where adjustable positioning is desired.

Figure 3:
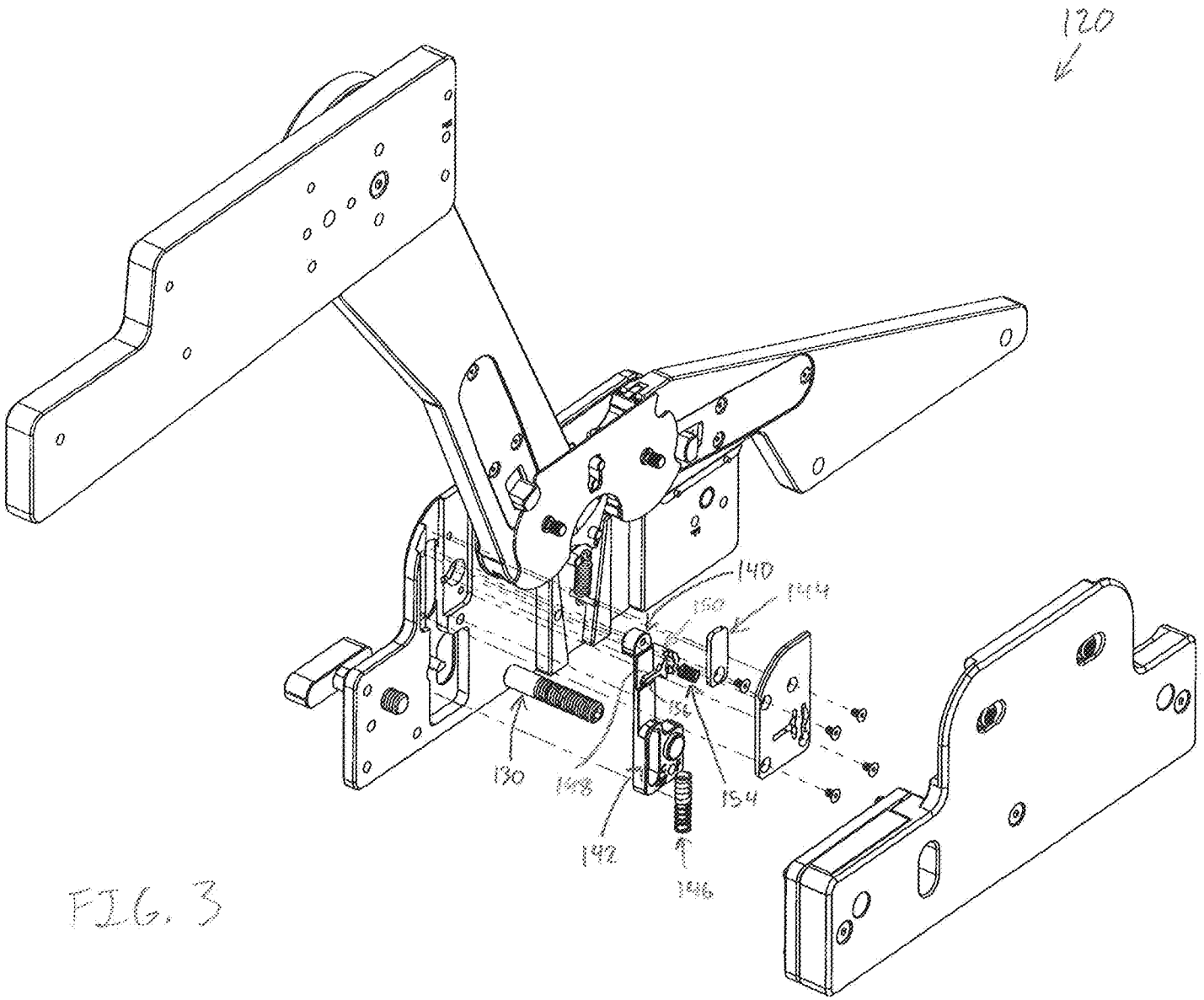
FIG. 3 shows an exploded right side perspective view of the seat slide-lock system of FIG. 1.

The seat 102 incorporates a seat slide-lock device 120, which may be integrated into the seat structure. FIG. 3 illustrates an exploded view of a seat slide-lock device 120, showing various components that may comprise the device. The seat slide-lock device 120 may include several elements working in conjunction to provide smooth movement and secure locking functionality.

One component of the seat slide-lock device 120 is a slide handle 140. The slide handle 140 is accessible to a user and allows for manual operation of the seat slide-lock device 120. The slide handle 140 may be designed to be easily gripped and manipulated by the user.

Another component of the seat slide-lock device 120 is the slide pin 130. The slide pin 130 is coupled to the slide handle 140 and is engageable with the seat slide rail 110 to secure the seat 102 in position. In some cases, the seat slide-lock device 120 may include a slide block 142 that connects the slide pin 130 to the slide handle 140. This configuration may be observed in FIG. 4, which provides another exploded view of the seat slide-lock mechanism. The slide block 142 may serve as an intermediary component, translating the movement of the slide handle 140 to the slide pin 130.

Figure 4:
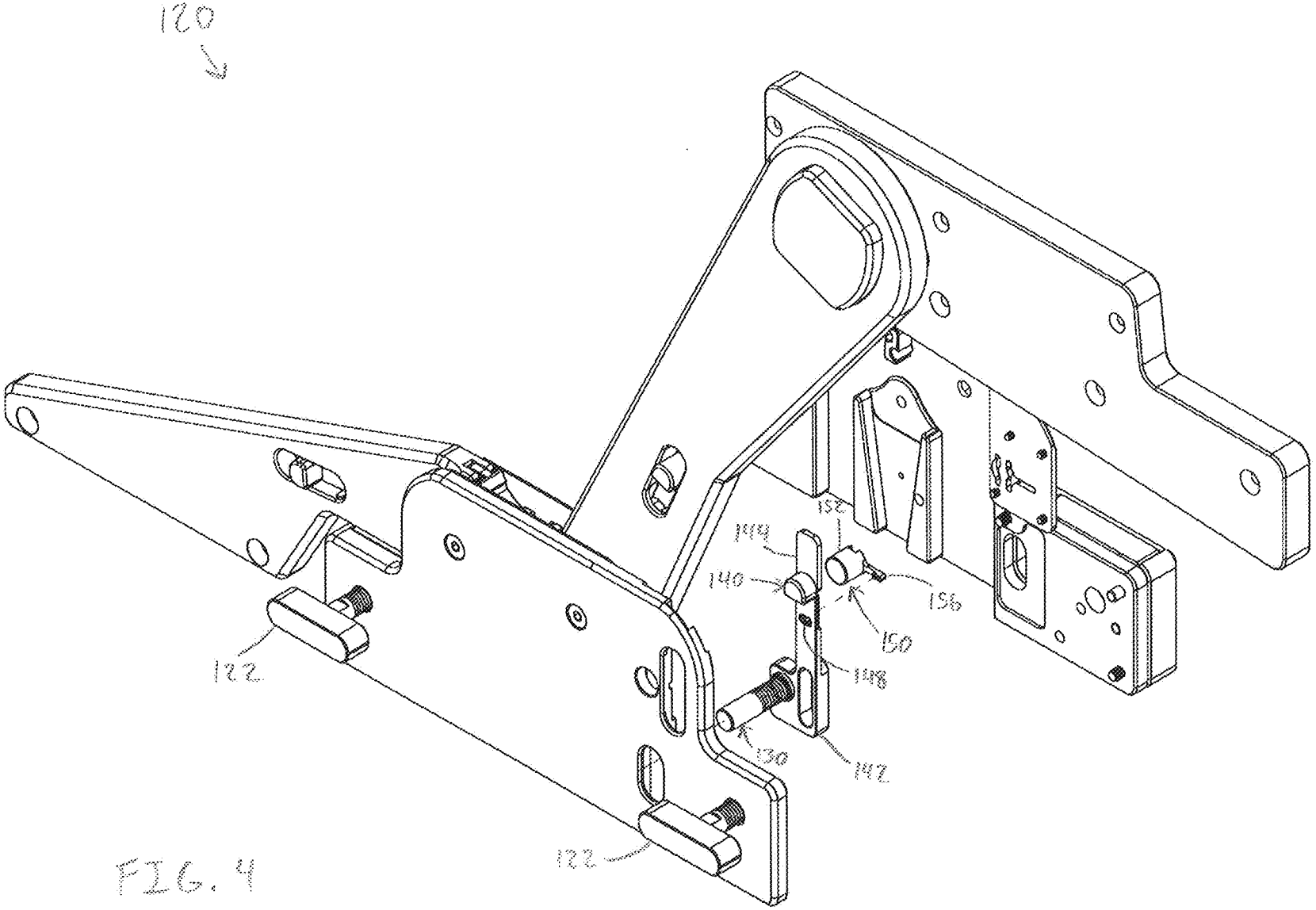
FIG. 4 shows an exploded left side perspective view of the seat slide-lock system of FIG. 1.

The seat slide-lock device 120 may also incorporate a release switch 150. FIG. 4 shows a release button 152 mechanism, which may be visible as a button connected to internal components that interact with the sliding arm. The release switch 150 may provide an additional safety feature, preventing unintended movement of the seat 102 when engaged.

In some cases, the seat 102 may include a second seat slide-lock device 120 on the opposite side of the seat 102. This configuration may enhance stability and ensure balanced locking along both sides of the seat 102. While not explicitly shown in FIG. 3 or FIG. 4, it is understood by those in the art that a symmetrical arrangement with a second slide-lock device 120 can be implemented.

The seat slide-lock device 120 may be designed to allow for precise control over the seat's position. When the slide handle 140 is actuated, it causes the slide pin 130 to move via the slide block 142, disengaging it from the detents 114 in the seat slide rail 110. This action may allow the seat 102 to move freely along the longitudinal axis 112 of the rail 110. When the desired position is reached, releasing the slide handle 140 causes the slide pin 130 to re-engage with a detent 114, securing the seat 102 in place. If the slide pin 130 is not in a position along the slide rail 110 to engage a detent 114, the seat 102 may be slid along the slide rail 110 until the slide pin 130 is in position to engage a detent 114.

The release switch 150 may add an extra layer of security to this mechanism. When engaged, the release switch 150 may prevent the slide handle 140 and slide pin 130 from moving, even if the slide handle 140 is accidentally bumped or pulled. This feature may be particularly valuable in dynamic environments where unintended seat movement could pose safety risks.

Figure 5:
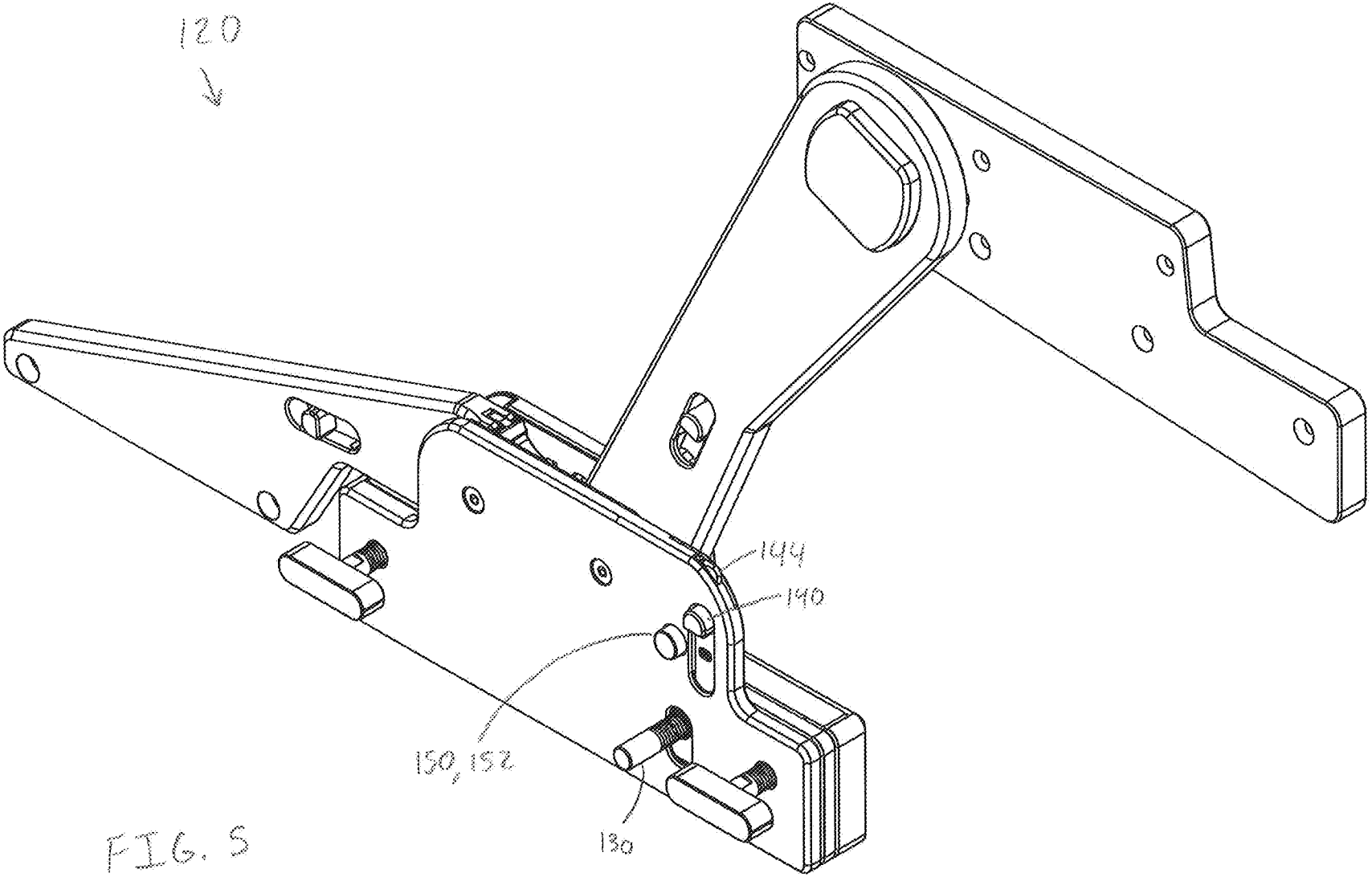
FIG. 5 shows a left side perspective view of the seat slide-lock system of FIG. 1 with the slide handle in the disengaged position.
Figure 6:
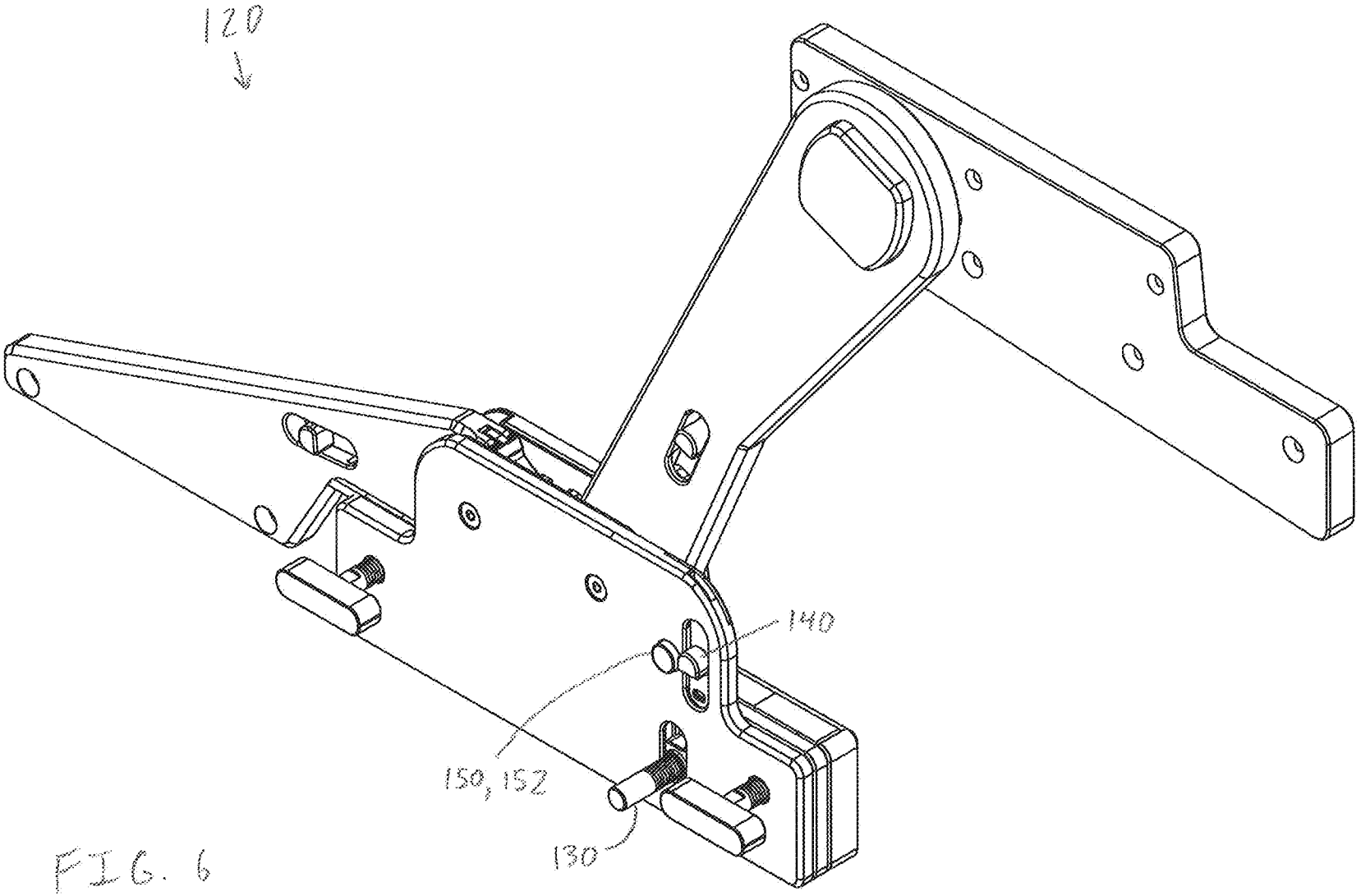
FIG. 6 shows a left side perspective view of the seat slide-lock system of FIG. 1 with the slide handle in the engaged position.

The slide handle 140 may be accessible to a user and may be movable between an engaged position and a disengaged position. FIG. 5 shows the slide handle 140 positioned in the disengaged position, and FIG. 6 shows the slide handle 140 positioned in the engaged position. Because the slide pin 130 is coupled to the slide handle 140, the slide pin 130 moves with the slide handle 140 when the slide handle 140 moves between the engaged position and the disengaged position. The slide handle 140 shown in FIGS. 1-6 is designed to be further from the seat slide rail 110 in the disengaged position than in the engaged position.

In some cases, the slide handle 140 may include a visual indicator 144 in the form of a red stripe on a protrusion coupled to the slide handle 140. The protrusion of the visual indicator 144 moves with the slide handle 140 such that, when the slide handle 140 moves from the engaged position to the disengaged position, the protrusion of the visual indicator 144 protrudes from the housing of the seat slide-lock device 120 and is visible to a user. When the slide handle 140 is moved to the engaged position, the protrusion of the visual indicator 144 moves back inside of the housing such that the protrusion of the visual indicator 144 is no longer visible. This feature provides a clear visual cue to the user about the current state of the locking mechanism. When the red stripe is visible, the user knows that the seat 102 is not securely locked and may be free to move.

When the slide handle 140 is in the engaged position, the slide pin 130 may engage with a detent 114 in the seat slide rail 110, preventing the seat 102 from moving relative to the longitudinal axis 112 of the seat slide rail 110. Conversely, when the slide handle 140 is moved to the disengaged position, the slide pin 130 is disengaged from the detent 114, allowing the seat 102 to move freely along the seat slide rail 110.

The slide handle 140 may have an ergonomic curved shape to improve grip. The ergonomic shape may allow users to easily grasp and operate the slide handle 140, facilitating smooth transitions between the engaged and disengaged positions.

In some cases, the movement of the slide handle 140 between the engaged and disengaged positions may be accomplished through a pivoting or lifting motion. This movement of the slide handle 140 translates directly to the slide pin 130, causing the slide pin 130 to move in and out of engagement with the detents 114 in the seat slide rail 110.

The seat slide-lock system 100 also includes a release switch 150. The release switch 150 is movable between a locked position and an unlocked position. FIG. 5 illustrates an isometric view of a seat slide-lock mechanism, showing a release button 152 of the release switch 150 adjacent to the slide handle 140. The release switch 150 is in the locked position when the pressable button 152 is in an extended position and is in the unlocked position when the pressable button 152 is in a depressed position. The release switch 150 is biased toward the locked position by a release spring 154 and is urgable toward the disengaged position. This biasing ensures that the release switch 150 defaults to the locked position, providing an additional layer of safety.

The release switch 150 is designed to prevent or allow movement of the slide handle 140 and slide pin 130, depending on its position. When the release switch 150 is in the locked position, the release switch 150 may prevent the slide handle 140 and slide pin 130 from moving from the disengaged position toward the engaged position. Conversely, when the release switch 150 is in the unlocked position, the release switch 150 may allow the slide handle 140 and slide pin 130 to move from the disengaged position toward the engaged position.

The release switch 150 locks the slide handle 140 and slide pin 130 in the disengaged position so that a user may move the seat 102 along the slide rails 110 to a new position without holding the slide handle 140 in the disengaged position. Once the seat 102 is in the desired position, the release button 152 can be pressed to allow the slide handle 140 and slide pin 130 to move toward the engaged position such that the slide pin 130 can engage a detent 114 to secure the seat 102 in the desired position.

The release switch 150 shown in FIGS. 3 and 4 includes a release protrusion 156, and the slide handle 140 defines a release opening 148. The release protrusion 156 engages the release opening 148 when slide handle 140 is in the disengaged position and the release switch 150 is in the locked position. This engagement obstructs the movement of the slide handle 140 from the disengaged position toward the engaged position. When the release switch 150 is urged toward the unlocked position, the release protrusion 156 disengages the release opening 148 such that the slide handle 140 can be biased back toward the engaged position.

The various components of the seat slide-lock system 100 work together to provide secure locking and smooth unlocking operations.

When a user wishes to adjust the seat position, the release switch 150 is moved to the unlocked position. This action allows the slide handle 140 to be moved, which in turn moves the slide pin 130. As the slide handle 140 is actuated, the slide pin 130 disengages from the detent 114 in the seat slide rail 110. This disengagement allows the seat 102 to move freely along the longitudinal axis 112 of the rail 110.

When the slide handle 140 is moved to the disengaged position, the release protrusion 156 of the release switch 150 in the locked position engages the release opening 148 to lock the slide handle 140 in the disengaged position. Once the desired position is reached, the user can press the release button 152 to cause the release switch 150 to move from the locked position to the unlocked position, causing the release protrusion 156 to disengage with the release opening 148 of the slide handle 140. A pin spring 146 biases the slide handle 140 and the slide pin 130 back toward the engaged position to re-engage the slide pin 130 with a detent 114, securing the seat 102 in place relative to the slide rail 110.

The combination of these components and their interactions results in a system that provides both ease of use and safety. The biasing of the slide pin 130 and slide handle 140 toward the engaged position helps ensure that the seat 102 remains locked by default. The release switch 150 adds an extra layer of security, preventing accidental disengagement. The visual indicator 144 provides clear feedback to the user about the system's state. Together, these features contribute to a robust and user-friendly seat slide-lock system 100.

A number of example implementations are provided herein. However, it is understood that various modifications can be made without departing from the spirit and scope of the disclosure herein. As used in the specification, and in the appended claims, the singular forms "a," "an," "the" include plural referents unless the context clearly dictates otherwise. The term "comprising" and variations thereof as used herein is used synonymously with the term "including" and variations thereof and are open, non-limiting terms. Although the terms "comprising" and "including" have been used herein to describe various implementations, the terms "consisting essentially of" and "consisting of" can be used in place of "comprising" and "including" to provide for more specific implementations and are also disclosed.

Disclosed are materials, systems, devices, methods, compositions, and components that can be used for, can be used in conjunction with, can be used in preparation for, or are products of the disclosed methods, systems, and devices. These and other components are disclosed herein, and it is understood that when combinations, subsets, interactions, groups, etc. of these components are disclosed that while specific reference of each various individual and collective combinations and permutations of these components may not be explicitly disclosed, each is specifically contemplated and described herein. For example, if a device is disclosed and discussed each and every combination and permutation of the device are disclosed herein, and the modifications that are possible are specifically contemplated unless specifically indicated to the contrary. Likewise, any subset or combination of these is also specifically contemplated and disclosed. This concept applies to all aspects of this disclosure including, but not limited to, steps in methods using the disclosed systems or devices. Thus, if there are a variety of additional steps that can be performed, it is understood that each of these additional steps can be performed with any specific method steps or combination of method steps of the disclosed methods, and that each such combination or subset of combinations is specifically contemplated and should be considered disclosed.

What is claimed is:

1. A seat slide-lock system, the system comprising:

a seat slide rail having a longitudinal axis, wherein the seat slide rail defines at least one detent; and a seat movable along the longitudinal axis of the seat slide rail, the seat including a seat slide-lock device, the device comprising:

a slide handle accessible to a user, wherein the slide handle is movable between an engaged position and a disengaged position, a slide pin coupled to the slide handle such that the slide pin moves with the slide handle when the slide handle moves between the engaged position and the disengaged position, wherein the slide pin is engageable with the detent of the seat slide rail in the engaged position and is disengaged with the detent of the seat slide rail in the disengaged position, wherein the seat is prevented from moving relative to the longitudinal axis of the seat slide rail in the engaged position and is allowed to move relative to the longitudinal axis of the seat slide rail in the disengaged position, and a release switch accessible to the user, wherein the release switch is movable between a locked position and an unlocked position, wherein the release switch is configured to prevent the slide handle and slide pin from moving from the disengaged position toward the engaged position when in the locked position, wherein the release switch is configured to allow the slide handle and slide pin to move from the disengaged position toward the engaged position when in the unlocked position.

2. The system of claim 1, wherein the slide pin and slide handle are biased toward the engaged position by a pin spring and are urgable toward the disengaged position.

3. The system of claim 1, wherein the release switch is biased toward the locked position by a release spring and is urgable toward the unlocked position.

4. The system of claim 1, wherein the release switch includes a pressable button.

5. The system of claim 4, wherein the release switch is in the locked position when the pressable button is in an extended position and is in the unlocked position when the pressable button is in a depressed position.

6. The system of claim 1, wherein the release switch is prevented from moving from the unlocked position toward the locked position when the slide handle and slide pin are in the engaged position.

7. The system of claim 1, wherein the release switch includes a release protrusion, wherein the slide handle defines a release opening, wherein the release protrusion engages the release opening and obstructs movement of the slide handle from the disengaged position to the engaged position when the release button is in the locked position, wherein the release protrusion does not engage the release opening or obstruct the movement of the slide handle from the disengaged position to the engaged position when the release button is in the unlocked position.

8. The system of claim 7, wherein the slide handle obstructs the movement of the release protrusion from the unlocked position toward the locked position when the slide handle is in the engaged position.

9. The system of claim 1, wherein the slide handle is further from the seat slide rail in the disengaged position than it is in the engaged position.

10. The system of claim 1, wherein the seat slide rail defines two or more detents, wherein the slide pin is engageable with each of the two or more detents.

11. The system of claim 1, wherein the seat slide rail is a first seat slide rail, the system further comprising a second seat slide rail.

12. The system of claim 11, wherein the seat slide-lock device is a first seat slide-lock device disposed along a first side of the seat, wherein the seat further includes a second seat slide-lock device disposed along a second side of the seat.

13. The system of claim 1, wherein the seat further includes one or more fixed pins, wherein the seat slide rail defines a slide channel extending parallel to the longitudinal axis of the seat slide rail, wherein the one or more fixed pins are slidably disposed within the slide channel.

14. A seat slide-lock device, the device comprising:

a slide handle accessible to a user, wherein the slide handle is movable between an engaged position and a disengaged position;

a slide pin coupled to the slide handle such that the slide pin moves with the slide handle when the slide handle moves between the engaged position and the disengaged position, wherein the slide pin is engageable with a detent of a seat slide rail in the engaged position and is disengaged with the detent of the seat slide rail in the disengaged position, wherein the seat is prevented from moving relative to a longitudinal axis of the seat slide rail in the engaged position and is allowed to move relative to the longitudinal axis of the seat slide rail in the disengaged position; and a release switch accessible to the user, wherein the release switch is movable between a locked position and an unlocked position, wherein the release switch is configured to prevent the slide handle and slide pin from moving from the disengaged position toward the engaged position when in the locked position, wherein the release switch is configured to allow the slide handle and slide pin to move from the disengaged position toward the engaged position when in the unlocked position.

15. The device of claim 14, wherein the slide pin and slide handle are biased toward the engaged position by a pin spring and are urgable toward the disengaged position.

16. The device of claim 14, wherein the release switch is biased toward the locked position by a release spring and is urgable toward the unlocked position.

17. The device of claim 14, wherein the release switch includes a pressable button.

18. The device of claim 17, wherein the release switch is in the locked position when the pressable button is in an extended position and is in the unlocked position when the pressable button is in a depressed position.

19. The device of claim 14, wherein the release switch is prevented from moving from the unlocked position toward the locked position when the slide handle and slide pin are in the engaged position.

20. The device of claim 14, wherein the release switch includes a release protrusion, wherein the slide handle defines a release opening, wherein the release protrusion engages the release opening and obstructs the movement of the slide handle from the disengaged position to the engaged position when the release button is in the locked position, wherein the release protrusion does not engage the release opening or obstruct the movement of the slide handle from the disengaged position to the engaged position when the release button is in the unlocked position.

21. The device of claim 20, wherein the slide handle obstructs the movement of the release protrusion from the unlocked position toward the locked position when the slide handle is in the engaged position.

22. The device of claim 14, wherein the slide handle is configured to be further from the seat slide rail in the disengaged position than it is in the engaged position.

* * * * *